US006229557B1

(12) United States Patent
Ooyama

(10) Patent No.: US 6,229,557 B1
(45) Date of Patent: May 8, 2001

(54) THERMAL PRINTHEAD

(75) Inventor: Shingo Ooyama, Fukuoka (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/530,905

(22) PCT Filed: Sep. 8, 1999

(86) PCT No.: PCT/JP99/04883

§ 371 Date: May 8, 2000

§ 102(e) Date: May 8, 2000

(87) PCT Pub. No.: WO00/13907

PCT Pub. Date: Mar. 16, 2000

(30) Foreign Application Priority Data

Sep. 9, 1998 (JP) ..... 10-255193

(51) Int. Cl.[7] ..... B41J 2/335
(52) U.S. Cl. ..... 347/200
(58) Field of Search ..... 347/200; 29/611

(56) References Cited

FOREIGN PATENT DOCUMENTS 5-221001 * 8/1993 (JP) .
6-79894 * 3/1994 (JP) .

* cited by examiner

*Primary Examiner*—Huan Tran
(74) *Attorney, Agent, or Firm*—Morgan, Lewis & Bockius LLP

(57) ABSTRACT

The object of the invention is to enhance precision in bonding the heating board and the radiating plate of a thermal print head, in the thermal print head A composed by attaching the heating board 2 on the surface of which a heating resistor for printing 4 is formed on the upper surface of the radiating plate 1, an identification mark M that functions as a positioning reference when the heating board 2 is attached on the radiating plate 1 is provided on the heating board 2 at a fixed interval from the heating resistor 4 and in addition, the identification mark M has a vertical side M1 equivalent to a positioning reference line D perpendicular to a direction in which the heating resistor of the heating board 2 is arranged (the direction of the x-axis).

16 Claims, 4 Drawing Sheets

FIG. 8( f )

THERMAL PRINTHEAD

TECHNICAL FIELD

The present invention relates to a thermal print head composed of a heating board and a radiating plate, detailedly relates to a thermal print head provided with an identification mark for positioning when a heating board is bonded to a radiating plate.

BACKGROUND ART

Heretofore, this type of thermal print head is composed by attaching a ceramic heating board onto the upper surface of a metallic radiating plate. A heating resistor for printing, a common electrode pattern and an individual electrode pattern are formed on the surface of the heating board and plural IC chips for driving are mounted. In case the heating board having the configuration described above is attached to the radiating plate, an adhesive and a pressure sensitive adhesive tape are generally used, however, in any case, precise positioning is required and particularly, to position precisely in the longitudinal direction of the heating board, that is, in the direction of the x-axis which is a direction in which the heating resistor is arranged, heretofore, a first dot part (the leading end) and a last dot part (the trailing end) of the heating resistor linearly formed on the heating board are based.

That is, the first dot part and the last dot part of the heating resistor are directly recognized as a binary number by a camera and others, the heating board is precisely set on the radiating plate and is bonded based upon it.

However, recently, the demand of a thermal print head wherein a heating resistor is covered with a conductive protective coat is increased and a problem that precision in bonding between a heating board and a radiating plate decreases because such a conductive protective coat is formed occurs.

That is, as a heating resistor is generally black, while a conductive protective coat is also approximately black, it is difficult to recognize the first dot part and the last dot part of the heating resistor by a camera and as a result, misregistration by wrong recognition occurs.

Therefore, it is considered that an identification mark different from a heating resistor is required and is based, however, wrong recognition is caused depending upon the shape of a mark and satisfactory bonding precision is not achieved. The object of the invention is to provide a thermal print head wherein an identification mark for positioning enabling solving such problems is provided.

DISCLOSURE OF THE INVENTION

To solve the problems, a first aspect of the invention is based upon a thermal print head wherein a heating board on the surface of which a heating resistor for printing is formed is attached on the upper surface of a radiating plate and is characterized in that the heating board is provided with an identification mark having the vertical side for an orientation arranged perpendicularly to a direction in which heating resistor is arranged so that the identification mark functions as the orientation when the heating board is attached to the radiating plate.

Therefore, as a first dot part and a last dot part of the heating resistor can be more definitely recognized than they are directly recognized as a binary number by a camera, positioning when the heating board is attached to the radiating plate can be precisely performed. Particularly, even if the identification mark is formed using gold foil and others which is hardly recognized when the parts are recognized as a binary number, a longitudinal reference line formed by the vertical side definitely appears and wrong recognition can be possibly prevented.

Also, a second aspect of the invention is based upon the thermal print head according to the first aspect of the invention and is characterized in that the heating resistor is covered with a protective coat. That is, as positioning can be precisely performed even if it is difficult to recognize the heating resistor as a binary number by a camera because of the protective coat, positional precision for attaching the heating board onto the radiating plate can be enhanced.

Also, a third aspect of the invention is based upon the thermal print head according to the first aspect of the invention and is characterized the identification mark is provided in a position except the protective coat.

Therefore, even if the identification mark is formed in approximately the same color as that of the protective coat, a precise positional reference can be acquired.

Also, a fourth aspect of the invention is based upon the thermal print head according to the first aspect of the invention and is characterized in that as for the identification mark, the vertical side is provided in only one location. Therefore, there is no possibility that another vertical side is recognized as a reference position by mistake.

A fifth aspect of the invention is based upon the thermal print head according to any of the first to third aspects of the invention and is characterized in that the identification mark is composed of an X reference line formed by the vertical side and a Y reference line formed by the side perpendicular to the vertical side.

According to such configuration, alignment not only in the longitudinal direction (the direction of X) but in the direction of Y can be achieved and extremely precise alignment is enabled.

A sixth aspect of the invention is based upon the thermal print head according to the first aspect of the invention and is characterized in that the identification mark is made of a thick film printed pattern.

A seventh aspect of the invention is based upon the thermal print head according to the first aspect of the invention and is characterized in that the identification mark is made of a thin film pattern.

An eighth aspect of the invention is based upon the thermal print head according to the sixth or seventh aspect of the invention and is characterized in that the identification mark is formed in a process for forming an electrode pattern. According to such configuration, the identification mark can be formed at the same time that the electrode pattern is formed without requiring another process and further, as relative positioning is applied to the electrode pattern by a mask, extremely precise positioning is enabled.

Also, a ninth aspect of the invention is based upon the thermal print head according to any of the first to the third aspects of the invention and is characterized in that the identification mark is a polygon having the vertical side as one side. Therefore, in case the polygon is recognized as a binary number, the plane is clearly shown and the vertical side to be a reference can be definitely recognized. Also, for example, in the case of a polygon having the side perpendicular to the vertical side, positioning not only in the longitudinal direction of the heating board but in the direction of the width can be precisely performed.

Further, a tenth aspect of the invention is based upon the thermal print head according to any of the first to third aspects of the invention and is characterized in that the identification mark is a semicircle having the vertical side as one side. Therefore, the area of the mark to acquire precise recognition can be reduced up to the required minimum limit, the quantity of pasted gold, aluminum and others for forming the mark can be reduced and the cost can be reduced.

An eleventh aspect of the invention is based upon a method of mounting the heating board on the surface of which the heating resistor for printing is formed on the radiating plate and forming the thermal print head and is characterized in that a process for forming the heating board on which the heating resistor for printing, the identification mark having the vertical side perpendicular to a direction in which the heating resistor is arranged and the electrode pattern connected to the heating resistor are formed and a process for aligning and fixing the heating board on the radiating plate using the vertical side of the identification mark as a positioning reference line are included. Therefore, as the first dot part and the last dot part of the heating resistor can be more definitely recognized than they are directly recognized as a binary number by a camera, positioning when the heating board is attached on the radiating plate can be precisely performed. Particularly a longitudinal reference line formed by the vertical side to be a reference is definitely shown and wrong recognition can be possibly prevented.

A twelfth aspect of the invention is based upon the method of manufacturing the thermal print head according to the eleventh aspect of the invention and is characterized in that the identification mark is formed in the process for forming the electrode pattern. According to such a method, the identification mark can be easily formed without requiring another process.

A thirteenth aspect of the invention is based upon the method of manufacturing the thermal print head according to the eleventh aspect of the invention and is characterized in that the identification mark is composed of an X reference line formed by the vertical side and a Y reference line formed by the side perpendicular to the vertical side.

A fourteenth aspect of the invention is based upon the method of manufacturing the thermal print head according to the eleventh aspect of the invention and is characterized in that the process for forming the identification mark is equivalent to the process for forming the electrode pattern. According to such configuration, alignment not only in the longitudinal direction (the direction of X) but in the direction of Y can be achieved and extremely precise alignment is enabled.

A fifteenth aspect of the invention is based upon the method of manufacturing the thermal print head according to the fourteenth aspect of the invention and is characterized in that the process for forming the identification mark includes a thick film printing process.

A sixteenth aspect of the invention is based upon the method of manufacturing the thermal print head according to the fourteenth aspect of the invention and is characterized in that the process for forming the identification mark includes the thick film printing process for printing on the whole surface and a pattern forming process for patterning it by photolithography.

A seventeenth aspect of the invention is based upon the method of manufacturing the thermal print head according to the fourteenth aspect of the invention and is characterized in that the process for forming the identification mark includes a thin film forming process and the pattern forming process for patterning it by photolithography.

The invention is based upon a thermal print head wherein a heating board on the surface of which a heating resistor for printing is formed is attached on the upper surface of a radiating plate and is characterized in that an identification mark which functions as a positioning reference when a heating board is attached on a radiating plate is provided on the heating board at a fixed interval from a heating resistor and in addition, the identification mark has the vertical side equivalent to a positioning reference line in the direction of the x-axis equivalent to the longitudinal direction of the heating board.

That is, the first dot part and the last dot part of the heating resistor can be more definitely recognized by providing the identification mark for positioning on the heating board than they are directly recognized as a binary number by a camera as heretofore, positioning when the heating board is attached on the radiating plate can be precisely performed and attaching precision can be enhanced.

The identification mark can be easily formed by printing and gold, aluminum and others are suitably used for paste for printing.

Particularly as for gold, in case it is binarized when it is monitored by a television camera, it is often judged blank, however, in the case of the shape described above, as a longitudinal reference line formed by the vertical side to be a reference is definitely shown, gold paste may be used.

The heating resistor of a thermal print head is often covered with a conductive protective coat and in the case of such a thermal print head the heating resistor of which is covered with a conductive protective coat and in addition, in case the color of the heating resistor is approximately the same color as that of the protective coat, it is difficult to directly recognize the first dot part and the last dot part of the heating resistor as a binary number by a monitor as described above, however, positioning can be precisely performed by providing the identification mark at a fixed interval from the heating resistor.

Such an identification mark can be also formed on the conductive protective coat, however, even if the identification mark is formed in approximately the same color as that of the protective coat, a precise positional reference can be acquired by providing the identification mark in a position in which no protective coat is provided The identification mark can be in a shape such as the vertical side is provided in only one location. The reason is that when plural vertical lines to be a reference are provided, they are misleading and other vertical lines are easily wrongly recognized as a reference position.

Also, the identification mark may be also a polygon and a semicircle each one side of which is a vertical side.

As these shapes are familiar and a plane is clearly shown in case they are binarized, the vertical side to be a reference can be definitely recognized.

Particularly, in the case of a polygon having the side perpendicular to the vertical side, positioning not only in the longitudinal direction of the heating board but in the direction of the width can be precisely performed.

Further, in the case of a triangle, paste such as gold and aluminum for forming the identification mark is saved and the cost can be reduced.

To reduce the quantity of paste, as the area can be minimized in the case of a semicircle, it is more effective to reduce the cost.

BEST MODE FOR CARRYING OUT THE INVENTION

Figure 1:
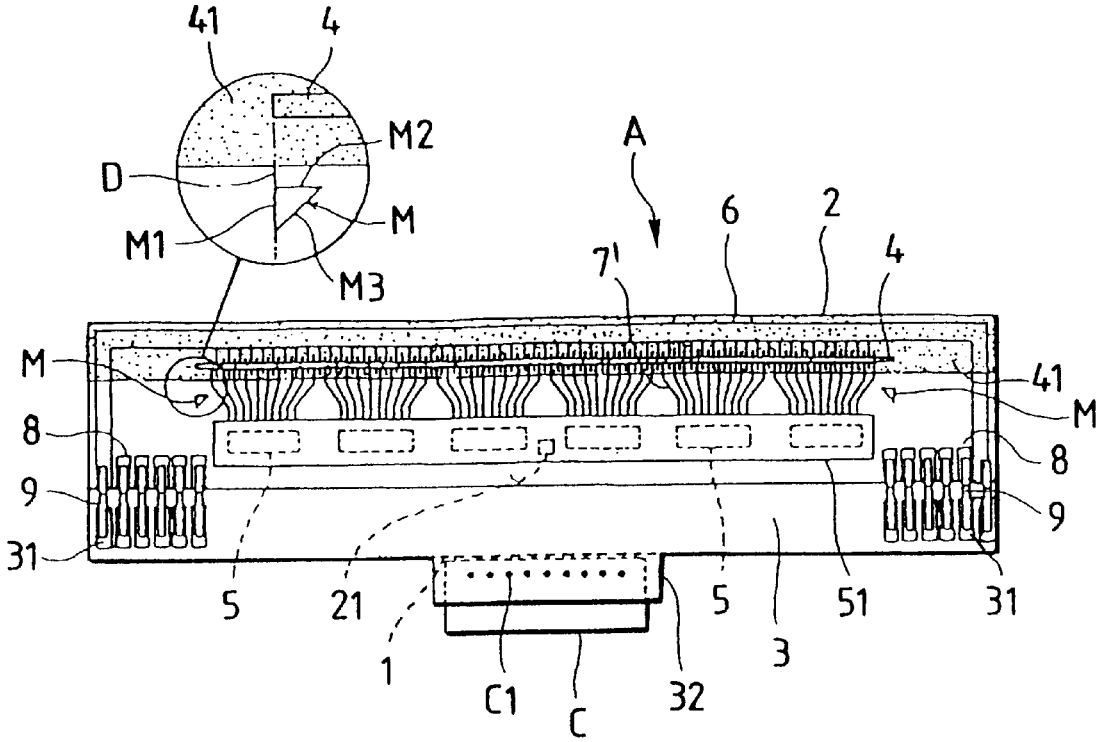
FIG. 1 is a plan showing a thermal print head equivalent to an embodiment.

Referring to the drawings, an embodiment of the invention will be described in detail below.

Figure 2:
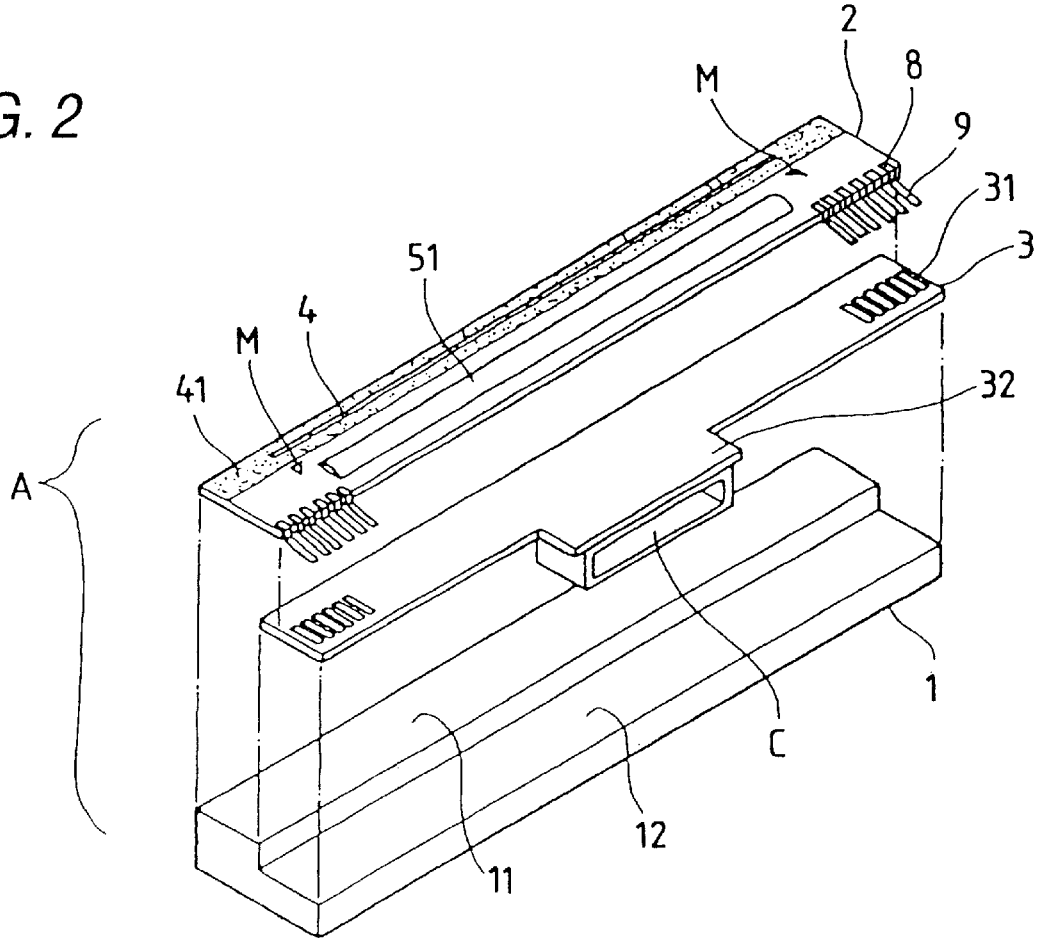
FIG. 2 is an exploded perspective view showing the thermal print head.

FIG. 1 is a plan showing a thermal print head A equivalent to this embodiment and FIG. 2 is an exploded perspective view showing the thermal print head A.

As shown in these drawings, the thermal print head A is characterized in that a ceramic heating board 2 and a printed circuit board 3 made of synthetic resin are aligned and fixed on the upper surface of a radiation plate 1 made of metal such as aluminum using an alignment mark M having a positioning reference line perpendicular to the longitudinal direction of the heating board 2. The alignment mark M is formed in a process for forming a common electrode pattern 6 or an individual electrode pattern 7.

The upper surface of the radiating plate 1 is composed of upper and lower planes for mounting the boards 11 and 12 as shown in FIG. 2, the heating board 2 is mounted on the higher plane 11 and the printed circuit board 3 is mounted on the lower plane 12. In this embodiment, the boards are bonded using a UV adhesive. In FIG. 2, the common electrode pattern 6, the individual electrode pattern 7 and IC for driving 5 are omitted.

The heating resistor for printing 4 is formed near one side in the longitudinal direction of the surface of the heating board 2 on the heating board 2 with the resistor linearly extended and plural IC chips for driving 5 are arranged in a row near a side opposite to the side described above. The heating resistor 4 made of ruthenium oxide ($RuO_2$) and formed linearly by thick film printing, the common electrode pattern 6 and the individual electrode pattern 7 are formed on the heating board 2. These common electrode pattern 6 and individual electrode pattern 7 are made of a gold thick film pattern formed alternately like a comb so that they are opposite from a direction perpendicular to the heating resistor under the heating resistor. The other end of the individual electrode pattern 7 is connected to the IC chip for driving 5. Also, the common electrode pattern 6 is composed of the side extended in the longitudinal direction of the heating board 2, an extended part extended along a shorter side on both sides of the side and connected to the printed circuit board 3 and a comb-type electrode part forming the teeth of a comb vertically extended from the side to the heating resistor 4 and the comb-type electrode part is connected to the heating resistor. The extended part is connected to the printed circuit board 3 via a terminal electrode 8 and a terminal lead 9 provided at both ends of the printed circuit board 3. The heating resistor 4 is covered with a conductive protective coat 41 having predetermined width. The conductive protective coat 41 is formed to prevent destruction by static electricity. The common electrode pattern and the individual electrode pattern are formed by patterning a gold film formed on the whole surface of the board by thick film printing using photolithography and the alignment mark M can be easily formed only by changing a mask used for the photolithography without requiring a special process. Also, it is desirable that the alignment mark has a vertical side M1 perpendicular to the longitudinal direction in which a minute and high-precision pattern can be formed because the alignment mark is formed by photolithography and a parallel side M2 perpendicular to the vertical side, a position in the longitudinal direction, that is, the direction of the x-axis and in the direction of the y-axis perpendicular to the direction of the x-axis is precisely defined and precise alignment is enabled by positioning based upon the alignment mark.

Each terminal electrode 8 connected to each IC chip for driving 5 via a wiring pattern not shown is formed at both ends of a longer side of the IC chip for driving 5, and each terminal electrode 8 and a connecting electrode 31 formed at right and left ends on the upper surface of the printed circuit board 3 are connected via the terminal lead 9.

Further, bonding wire not shown connects each individual electrode pattern 7 and the IC chip for driving 5 and connects the IC chip for driving 5 and each wiring pattern not shown, and the IC chip for driving 5 and the bonding wire are covered with a protective coat 51 made of synthetic resin.

As for the printed circuit board 3, a connector connection 32 is formed approximately in the center of the longer side of the printed circuit board, and a wiring circuit pattern not shown for connecting a connector C connected to the connector connection 32 for connecting an external device and the connecting electrode 31 is formed on the surface of the board.

A reference number 21 shown in FIG. 1 denotes a thermistor arranged between the rows of the IC chip for driving 5 as a thermostatic element and Cl denotes a contact pin of the connector C for connecting an external device.

When the thermal print head A is manufactured, a process for bonding the heating board 2 to the radiating plate 1 is required, however, in that case, first, the heating board 2 and the printed circuit board 3 are coupled via the terminal lead 9 and both are simultaneously bonded on the radiating plate 1. At this time, when the heating board 2 and the printed circuit board 3 are coupled and when both are bonded on the radiating plate 1, the heating board 2 is required to be precisely positioned using the alignment mark M and is required to be precisely laid on the surface to be mounted.

According to the invention, extremely precise positioning is enabled, compared with a conventional method of catching the heating board 2 by a pair of tweezers and others, driving an XY table, positioning and setting the heating board, recognizing any mark on the heating board 2, the first dot part and the last dot part as a mark of the heating resistor 4 as a binary number by a camera not shown. As described above, the invention is characterized in that the identification mark M that functions as a positioning reference in positioning is provided at a fixed interval from the heating resistor 4 on the heating board 2 and in addition, the identification mark M has a vertical side M1 equivalent to a positioning reference line D in the direction of the x-axis equivalent to the longitudinal direction of the heating board 2.

Figure 3:
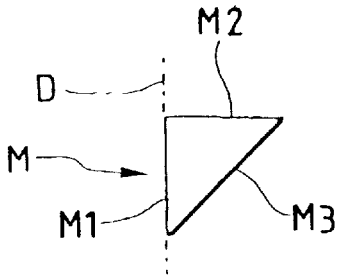
FIG. 3 is an explanatory drawing showing an embodiment of an identification mark.

In this embodiment, as shown in FIG. 1, the identification mark M is respectively formed by gold paste by printing at a predetermined interval on the side of the IC chip for driving respectively from a leading end equivalent to the first dot part of the heating resistor 4 and from a trailing end equivalent to the last dot part, and in addition, each identification mark M is in the shape of a right isosceles triangle composed of the vertical side M1 equivalent to the positioning reference line D, a horizontal side M2 perpendicular to the vertical side and having the same length as the vertical side and a hypotenuse M3 in this embodiment (see FIG. 3).

As described above, a reference can be more definitely recognized by providing the identification mark M for positioning than the first dot part and the last dot part of the heating resistor 4 are directly recognized as a binary number by a camera as heretofore and positioning when the heating board 2 is attached on the radiating plate 1 can be precisely performed.

In addition, as the heating resistor 4 is not directly recognized but the identification mark is provided in a position apart from the heating resistor even if the heating resistor 4 is covered with the conductive protective coat 41 as in this embodiment, precise positioning is enabled independent of whether the conductive protective coat 41 is provided or not and attaching positional precision can be enhanced.

Also, as the mark is in the shape of not a dot and a line but a plane figure, the vertical side M1 to be a reference line is definitely shown longitudinally. Therefore, even if the identification mark M is formed using gold paste often judged blank when binarized as in this embodiment, wrong recognition can be prevented.

Further, paste for forming the mark having the same color as that of the conductive protective coat 41 can be used by forming the identification mark M in a position apart from the conductive protective coat 41 as shown in FIG. 1 and the degree of freedom in selecting paste is increased.

Also, in this embodiment, as the vertical side M1 of the identification mark M is provided in only one location, no other vertical lines that may be recognized as a reference position by mistake exist, the vertical side can be precisely recognized and attaching positional precision can be more enhanced. Further, in this embodiment, as the horizontal side M2 perpendicular to the vertical side M1 is provided, positioning both in the longitudinal direction of the heating board 2 and in the direction of the width can be precisely performed.

In addition, the area of the identification mark M can be possibly reduced by providing a triangular mark, gold paste is saved and the cost can be reduced.

Figure 4:
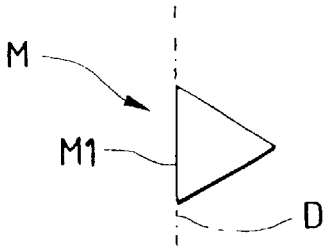
FIG. 4 is an explanatory drawing showing another embodiment of the identification mark.

Any identification mark M having the vertical side M1 equivalent to the positioning reference line D is included in the invention and the present invention is not limited to the identification marks described above. For example, the identification mark M may be also in the shape of an equilateral triangle having the vertical side as a base as shown in FIG. 4.

Figure 5:
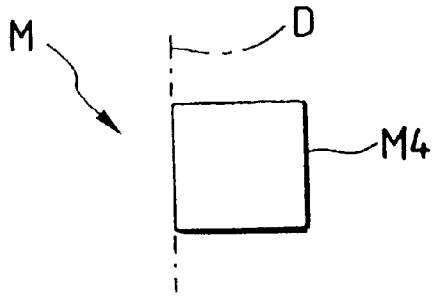
FIG. 5 is an explanatory drawing showing further another embodiment of the identification mark.

Also, the identification mark may be also a square shown in FIG. 5 or a rectangle for example without limiting to the triangle. However, in these cases, as a border line M4 equivalent to the vertical side M1 shown in FIG. 3 appears in parallel, it may be difficult to discriminate which vertical line is to be a reference.

Figure 6A:
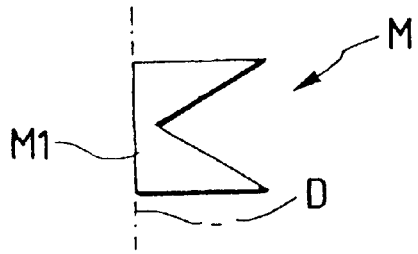
FIGS. 6(*a*) through 6(*c*) are explanatory drawings showing further another embodiment of the identification mark.
Figure 6B:
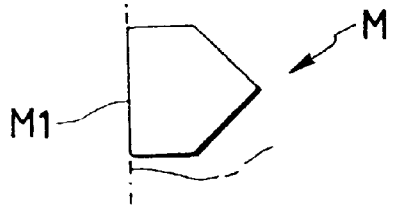
Figure 6C:
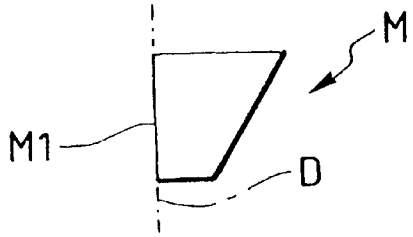

Further, the identification mark M may be also not only the triangle and the quadrangle but another polygon and for example, shapes shown in FIGS. 6(*a*) to 6(*c*) are conceivable.

Figure 7:
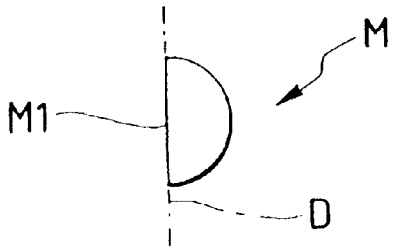
FIG. 7 is an explanatory drawing showing further another embodiment of the identification mark.
Figure 8A:
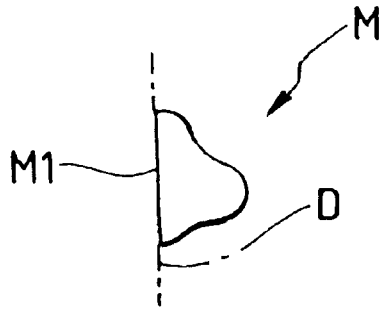
FIGS. 8(*a*) through 8(*f*) are explanatory drawings showing the other embodiment of the identification mark.
Figure 8B:
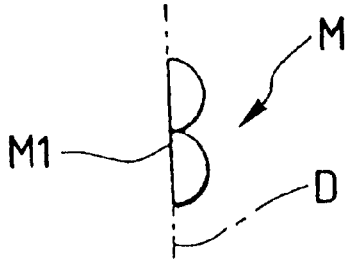
Figure 8C:
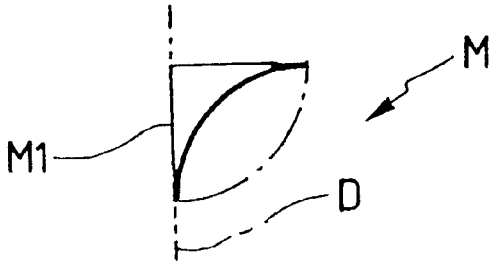
Figure 8D:
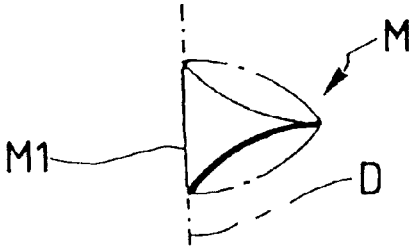
Figure 8E:
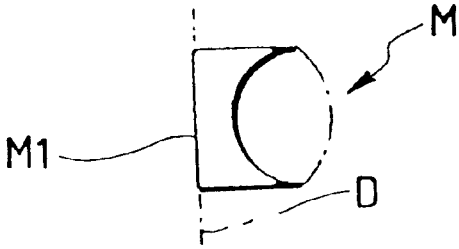
Figure 8E:
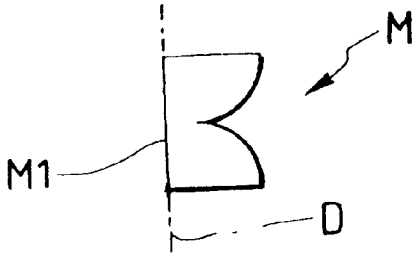

The identification mark M is not a polygon but may be also a semicircle having the vertical side M1 as one side as shown in FIG. 7. In this case, the area of the identification mark M can be reduced up to a required minimum limit and the cost can be most reduced because the quantity of paste for forming the mark is saved.

Furthermore, the identification mark M may be also in various shape except the shapes described above, for example shown in FIGS. 8(*a*) to 8(*f*). Any shape shown in FIGS. 3 to 8 except FIG. 5 has the vertical side M1 in only one location.

Needless to say, as for the shape of the identification mark M, further various shapes are conceivable in a range of the object of the invention. Also, a position in which the identification mark M is formed is also not limited to the embodiment, may be suitably determined and for example, may be also on the conductive protective coat 41.

Also, in the embodiment, the electrode pattern is formed by thick film printing and photolithography, however, a printing pattern using a mask screen having an electrode pattern and a pattern of an alignment mark may be also used.

Furthermore, an electrode pattern can be also formed by patterning a thin film pattern formed by a method such as vacuum deposition and sputtering by photolithography.

Also, in the embodiment, the heating resistor is composed of an integrated pattern formed linearly and for the electrode, the comb-type electrode is used, however, it need scarcely be said that the invention can be also applied to a case that the heating resistor is formed by an individual pattern. Furthermore, the alignment mark is not necessarily required to be formed in the electrode pattern forming process and may be also formed in another process.

INDUSTRIAL APPLICABILITY

According to the invention, in the thermal print head composed by attaching the heating board on the surface of which the heating resistor for printing is formed on the upper surface of the radiating plate, the identification mark to be a positioning reference when the heating board is attached on the radiating plate is provided at a fixed interval from the heating resistor on the heating board, in addition, the longitudinal reference line formed by the vertical side to be reference is definitely shown by providing a vertical side equivalent to a positioning reference line in the direction of the x-axis equivalent to the longitudinal direction of the heating board to the identification mark and wrong recognition can be possibly prevented, and positioning when the heating board is attached on the radiating plate can be precisely performed.

According to the invention, in the thermal print head, even if the heating resistor is covered with the protective coat, positional precision in attaching the heating board on the radiating plate can be enhanced as in the case described above.

According to the invention, as the identification mark is provided in a position apart from the protective coat, a precise positional reference can be acquired even if the identification mark is formed in approximately the same color as that of the protective coat and the degree of freedom in selecting the type of paste for forming the mark is increased.

According to the invention, as the identification mark has the vertical side in only one location, no other vertical sides are recognized as a reference position by mistake.

According to the invention, as the identification mark is a polygon having a vertical side as one side, a plane is clearly shown when binarized and the vertical side to be a reference can be definitely recognized. Also, in case the identification mark is a polygon having a bottom perpendicular to the vertical side, positioning not only in the longitudinal direction of the heating board but in the direction of the width can be precisely performed.

According to the invention, as the identification mark is a semicircle having a vertical side as one side, the area of the mark for acquiring precise recognition can be reduced up to a required minimum limit, the quantity of paste such as gold and aluminum for forming the mark can be reduced and the cost can be reduced.

What is claimed is:

1. A thermal print head comprising a heating board on the surface of which a heating resistor for printing is formed, the heating board being mounted on a radiating plate, wherein:

said heating board is provided with an identification mark having a vertical side for a positioning reference arranged perpendicularly to a direction in which said heating resistor is arranged so that the identification mark is a positioning reference when the heating board is attached on said radiating plate; and wherein said heating resistor is covered with a protective coat that is approximately black.

2. A thermal print head according to claim 1, wherein:

said identification mark is arranged at a predetermined interval from said heating resistor.

3. A thermal print head according to claim 1, wherein:

said identification mark has a vertical side in only one location.

4. A thermal print head according to claim 1, wherein:

said identification mark is composed of an X reference line formed by a vertical side and a Y reference line formed by a side perpendicular to the vertical side.

5. A thermal print head according to claim 1, wherein:

said identification mark is a thick film printed pattern.

6. A thermal print head according to claim 5, wherein:

said identification mark is formed in a process for forming an electrode pattern.

7. A thermal print head according to claim 1, wherein:

said identification mark is a thin film pattern.

8. A thermal print head according to claim 1, wherein:

said identification mark is a polygon having a vertical side as one side.

9. A thermal print head according to claim 1, wherein:

said identification mark is a semicircle having a vertical side as one side.

10. A method of mounting a heating board on the surface of which a heating resistor for printing is formed on a radiating plate and forming a thermal print head, comprising:

a process for forming a heating board on which a heating resistor for printing, an identification mark having a vertical side perpendicular to a direction in which the heating resistor is arranged and an electrode pattern connected to said heating resistor are formed;

a process for covering the heating resistor with a protective coating that is approximately black; and a process for aligning the heating board on said radiating plate using said vertical side of said identification mark as a positioning reference line and fixing said heating board.

11. A method of manufacturing the thermal print head according to claim 10, wherein:

said identification mark is formed in a process for forming said electrode pattern.

12. A method of manufacturing the thermal print head according to claim 10, wherein:

said identification mark is composed of an X reference line formed by a vertical side and a Y reference line formed by a side perpendicular to the vertical side.

13. A method of manufacturing the thermal print head according to claim 10, wherein:

a process for forming the identification mark is the same process as the process for forming the electrode pattern.

14. A method of manufacturing the thermal print head according to claim 13, wherein:

the process for forming the identification mark includes a thick film printing process.

15. A method of manufacturing the thermal print head according to claim 13, wherein:

the process for forming the identification mark includes the thick film printing process for printing on the whole surface and a pattern forming process for patterning the thick film by photolithography.

16. A method of manufacturing the thermal print head according to claim 13, wherein:

the process for forming the identification mark includes a thin film forming process and a pattern forming process for patterning the thin film by photolithography.

* * * * *